US008840417B2

(12) United States Patent
Chang

(10) Patent No.: US 8,840,417 B2
(45) Date of Patent: Sep. 23, 2014

(54) SAFETY SOCKET

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 24 days.

(21) Appl. No.: 13/687,948

(22) Filed: Nov. 28, 2012

(65) Prior Publication Data

US 2013/0244468 A1 Sep. 19, 2013

(30) Foreign Application Priority Data

Mar. 16, 2012 (TW) ..... 101204766 U

(51) Int. Cl.

| | |
|---|---|
| ***H01R 13/639*** | (2006.01) |
| ***H01R 24/78*** | (2011.01) |
| ***H01R 13/62*** | (2006.01) |
| *H01R 103/00* | (2006.01) |

(52) U.S. Cl.

CPC ..... *H01R 13/639* (2013.01); *H01R 24/78* (2013.01); *H01R 13/6395* (2013.01); *H01R 13/62* (2013.01); *H01R 2103/00* (2013.01)

USPC ..... 439/345

(58) Field of Classification Search

USPC ..... 439/346, 345, 341, 377, 275, 142, 140

See application file for complete search history.

(56) References Cited

U.S. PATENT DOCUMENTS

| | | | | |
|---|---|---|---|---|
| 4,600,258 | A * | 7/1986 | Hu | 439/140 |
| 4,616,285 | A * | 10/1986 | Sackett | 361/1 |
| 4,846,707 | A * | 7/1989 | Pirkle | 439/142 |
| 7,060,897 | B2 * | 6/2006 | Gorman | 174/53 |
| 7,232,349 | B1 * | 6/2007 | Chen | 439/810 |
| 7,261,580 | B1 * | 8/2007 | Secora | 439/341 |
| 7,452,230 | B1 * | 11/2008 | Miller et al. | 439/346 |
| 8,007,302 | B2 * | 8/2011 | Kleinke | 439/275 |
| 8,152,554 | B2 * | 4/2012 | Chapel et al. | 439/346 |
| 8,317,531 | B2 * | 11/2012 | Kleinke | 439/275 |
| 8,439,697 | B2 * | 5/2013 | Vass | 439/346 |
| 8,585,427 | B2 * | 11/2013 | Ukawa et al. | 439/377 |

FOREIGN PATENT DOCUMENTS

| | | |
|---|---|---|
| GB | 2 383 202 B | 5/2005 |
| TW | M285106 | 1/2006 |
| WO | WO 2010/029511 A1 | 3/2010 |

* cited by examiner

*Primary Examiner* — Alexander Gilman

(74) *Attorney, Agent, or Firm* — Muncy, Geissler, Olds & Lowe, P.C.

(57) ABSTRACT

A safety socket of the present invention has a lock mechanism which is utilized for engaging a tubular hexagonal shell of a plug when the plug inserts into the safety socket. Thus, the components of the safety socket can be arranged loose within easier spacing. Therefore, safety purpose is fulfilled with simplified structure. Manufacturing of the safety socket is facilitated.

10 Claims, 13 Drawing Sheets

SAFETY SOCKET

BACKGROUND OF THE INVENTION

1. Field of the Invention

The present invention relates to a safety socket which is able to prohibit unexpected removal of plug.

2. Description of the Prior Art

In conventional safety socket, some products are provided with a plate or flake accompanied with an opening. The plate/flake can be pressed tilt so as to engage a plug with the opening. Thus, removal of the plug is prohibited. Such socket and technique is detailed described in prior patent GB2383202. In addition, WO2010/029511 and TW utility model TWM285106 adopt the same technique to prevent removal of plug.

However, the plug utilized with the socket described above can be damaged by the socket easily. The socket is provided with a tilted engagement plate which is utilized for engaging pins of the plug. After repeated engagement of the engagement plate and the pins, the pins can be abraded easily. Moreover, for reducing cost, plugs are sometimes provided with thinned pins. Therefore, pins are always deformed and torqued by the socket. With the torture caused by the socket, lifetime of the plug can hardly be maintained.

In addition, the socket is difficult to be manufactured. Some plugs are provided with a hexagonal shell. Correspondingly, the socket should be provided with a hexagonal groove. Thus, arrangement and location of the engagement plate of the socket is limited by the groove. Size of the engagement plate should be small. Therefore, manufacture is difficult and cost is raised.

Besides, lifetime of the socket is limited. For releasement purpose, a release button should be provided on the socket. Accompanied with the button, linkage connected between the button and the engagement plate is also essential for the socket. However, the linkage has to detour round the groove in the narrowed and limited space. Reliability of the linkage would be questionable.

The present invention is, therefore, arisen to obviate or at least mitigate the above mentioned disadvantages.

SUMMARY OF THE INVENTION

The main object of the present invention is to provide a simplified safety socket which can engage the plug inserted therein.

Another main object of the present invention is to provide a safety socket with an engagement state which can be controlled by user easily.

The other object of the present invention is to provide a safety socket which has a prolonged lifetime and a diminished cost.

To achieve the above and other objects, a safety socket of the present invention includes a housing, a lock mechanism, and a switch mechanism.

The housing has a front surface. The front surface is formed with a group of socket holes which comprises at least two insertion holes and a groove. The groove encloses said two insertion holes. The group of socket holes is adapted for a corresponding plug to insert therein. The plug has at least two conductive pins each of which is able to insert in one of the insertion holes and a shell which is able to insert in the groove.

The lock mechanism is disposed in the housing. The lock mechanism is located adjacent to the groove. The lock mechanism is able to be switched between a first position and a second position. The shell is able to insert into and escape from the groove when the lock mechanism is located at the second position. The lock mechanism intervenes in the groove when the lock mechanism is switched toward the first position, so that removal of the shell which is inserted in the groove is prohibited. The lock mechanism has a tendency to return to the first position.

The switch mechanism is disposed on the housing. The switch mechanism is adapted for manual operation to switch the lock mechanism.

Therefore, the safety socket engages a plug with the hexagonal shell of the plug. The engagement plate of the safety socket can be arranged in periphery portion of the safety socket. Components of the safety socket are then arranged widely. Manufacturing and fabricating of the components are facilitated. In addition, the structure of the safety socket is amended, improving stability and durability of the safety socket.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
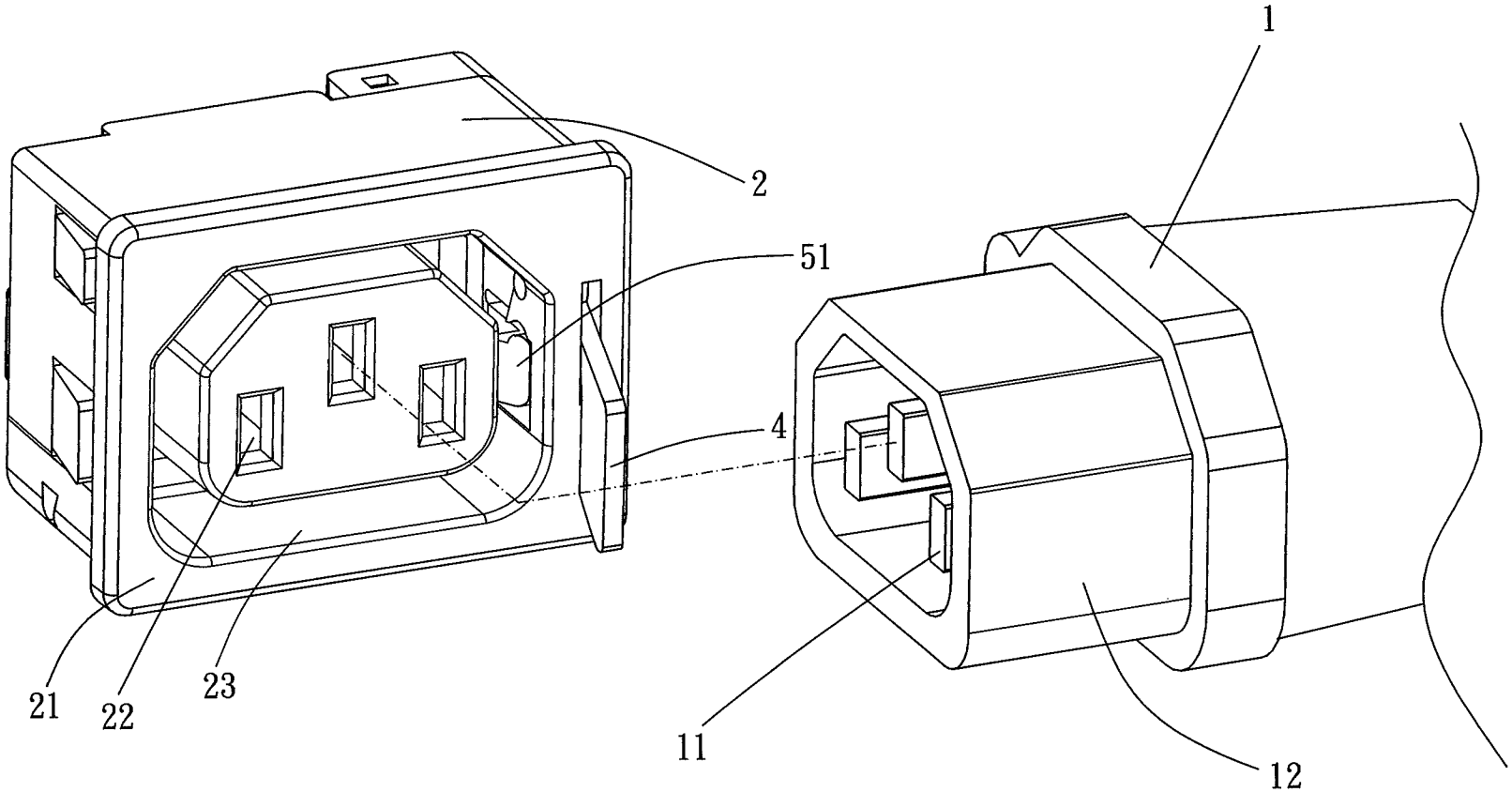
FIG. 1 is a stereogram showing a combination condition of a safety socket and a plug in a first embodiment of the present invention.
Figure 2:
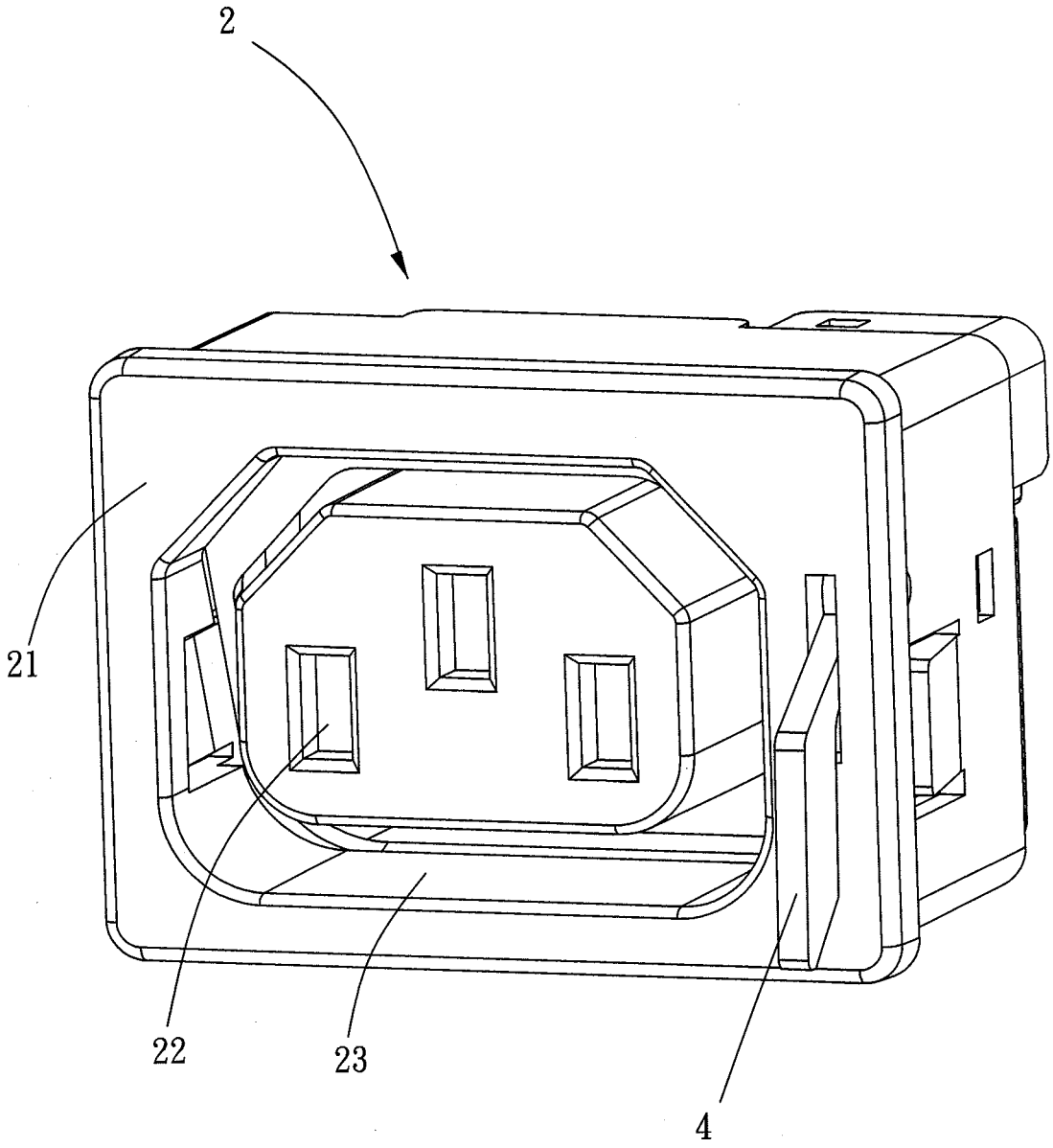
FIG. 2 is a stereogram showing a first embodiment of the present invention.
Figure 3:
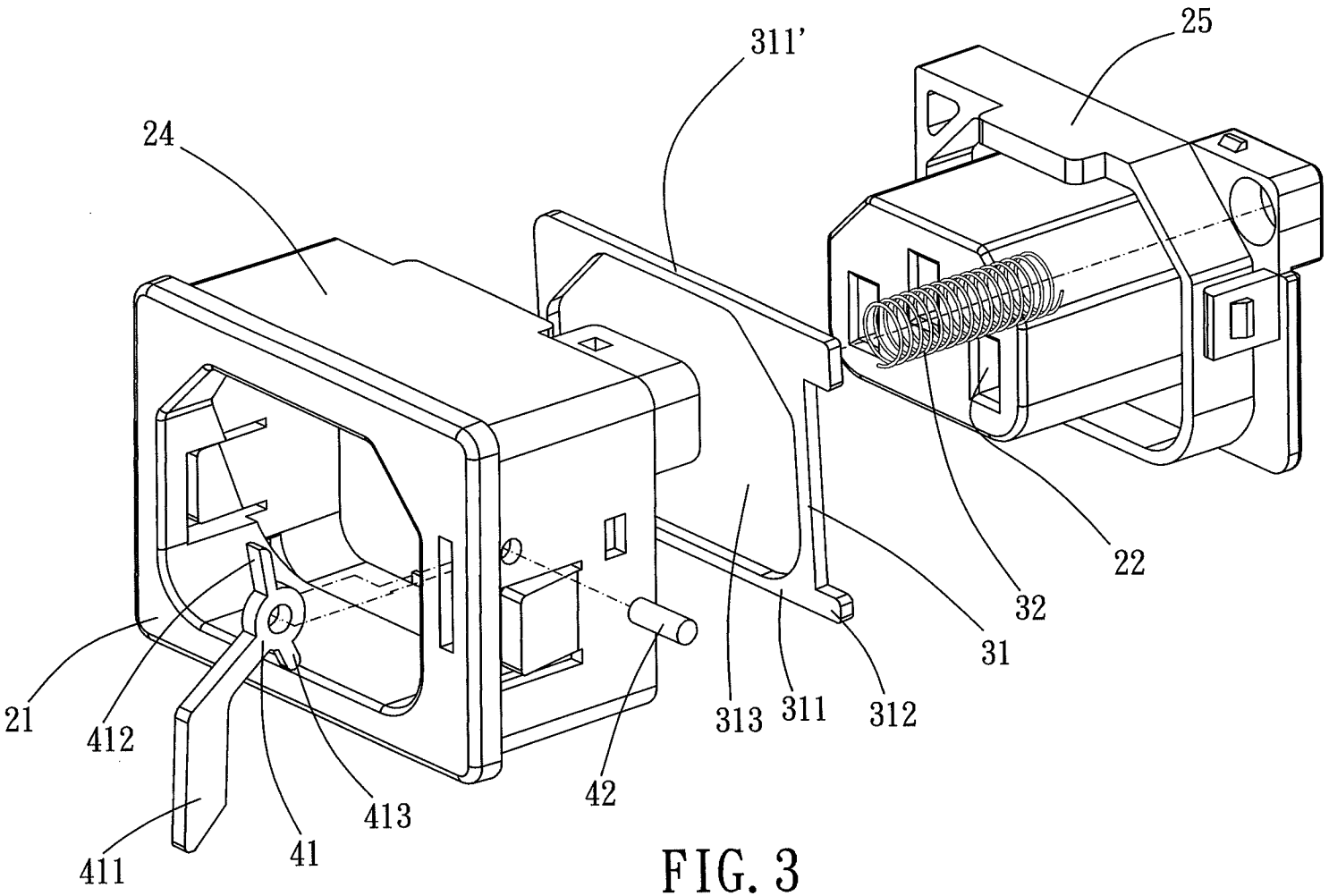
FIG. 3 is a break down drawing showing a first embodiment of the present invention.
Figure 4:
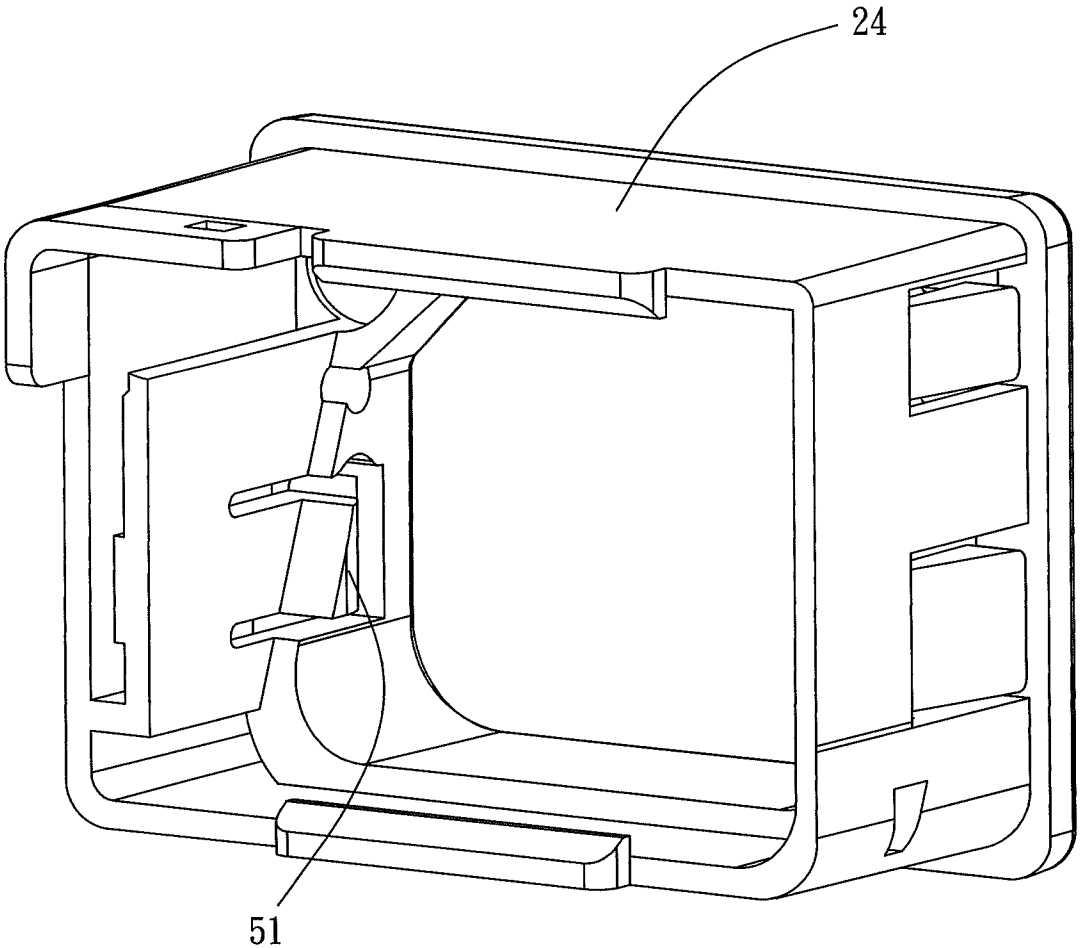
FIG. 4 is a stereogram showing an outer housing of a safety socket of a first embodiment of the present invention.

Please refer to FIG. 1 and FIG. 2 for a first embodiment of the present invention. The safety socket is provided for a plug 1 to be inserted therein. With corresponding operation, the safety socket can engage and lock or release the plug 1. The plug 1 includes two or three conductive pins 11 which are made of metal and formed as plates. In addition, the plug further includes a hexagonal tubular shell 12 which is arranged around the conductive pins 11. The safety socket includes a housing 2, a lock mechanism, and a switch mechanism 4. Preferably, a restrain mechanism is also included in.

Please refer to FIG. 2 to FIG. 5. The housing has a front surface 21. The front surface 21 is formed with a group of socket holes. In corresponding to the plug 1, the socket holes include two or three insertion holes 22 and a groove 23. The insertion holes 22 are adapted for the conductive pins of the plug to insert therein. The groove 23 encloses the insertion holes 22 and is adapted for the hexagonal shell of the plug to insert therein. Thus, the plug is able to insert into the corresponding group of socket holes. To fulfill fabrication purpose, the housing 2 of the present embodiment includes an outer housing 24 and an inner housing 25. The insertion holes 22 are formed on the inner housing 25. The groove 23 is defined between the outer housing 24 and the inner housing 25.

The lock mechanism is disposed in the housing 2 and adjacent to the groove 23. More specifically, the lock mechanism includes an engagement plate 31 and an elastic member 32. The engagement plate 31 is disposed in the housing 2. One side 311 of the engagement plate 31 abuts against the outer housing 24. The engagement plate 31 is formed with two pillared protrusions 312 at two ends of the side 311. The protrusions 312 abut against the outer housing. The engagement plate 31 is able to pivot, so that the opposite side 311' can move close to or away from the front surface 21. The engagement plate 31 is formed with an opening 313. The opening 313 has an appearance and a location corresponding to those of the groove 23. The engagement plate 31 is located adjacent to the groove 23, enclosing the groove 23. The side 311 of the engagement plate is parallel to the front surface 21. Thus, the engagement plate 31 pivots about an axis which is defined by the side 311 and is parallel to the front surface 21. Therefore, the lock mechanism or said engagement plate 31 can be switched or pivoted between a first position and a second position. When the engagement plate 31 pivots toward the first position, the engagement plate 31 is tilted to the front surface 21. Then, the engagement plate 31 intervenes in the groove 23, pressing on the shell which inserts into the groove 23. Thus, removal of the shell of the plug is resisted. When the engagement plate 31 pivots toward the second position, the engagement plate 31 is substantially parallel to the front surface 21. Thus, the shell is able to insert or escape from the groove 23 randomly. The phrase substantially parallel taken here means that an angle defined by the front surface 21 and the engagement plate 31 is shrunken or that the engagement plate 31 is parallel to the front surface 21 after the engagement plate 31 is pivoted to the second position. In other words, the engagement plate 31 not necessarily exactly parallel to the front surface 21. The elastic member 32 is arranged between the engagement plate 31 and the inner housing 25. The elastic member 32 provides an elastic force exerted on the engagement plate 31, so that the engagement plate 31 has a tendency to return to the first position. In other words, without external force or insertion of the shell, the engagement plate 31 is generally located at the first position. In other possible embodiments of the present invention, the elastic member 32 may be neglected. Alternatively, the engagement plate 31 can be produced bendable with suitable material and structure, and the elastic force can be provided by the bendable engagement plate.

The switch mechanism 4 is disposed on the housing. The switch mechanism is adapted for manual operation to change location of the lock mechanism so as to switch the lock mechanism. In the present embodiment, the switch mechanism 4 is used for switching the engagement plate 31 toward the second position. More specifically, the switch mechanism includes a controller 41. The controller 41 is disposed in the housing 2 by insertion of a pin 42, more particularly, is disposed in the outer housing 24. The controller 41 is able to rotate about the pin 42. The pin 42 or the rotation axis of the controller 41 is parallel to the front surface 21, and also parallel to the pivoting axis of the engagement plate 31. The controller has an activate portion 411, an extend portion 412, and a restrain portion 413. The activate portion 411, the extend portion 412, and the restrain portion 413 are formed as poles, stretching away from the pin 42. The activate portion 411 extends and protrudes outwardly from the front surface 21. The extend portion 412 abuts against the side 311' of the engagement plate 31 with a distal end thereof. As such, the activate portion 411 is provided for manual operation, switching and rotating the controller 41 between a lock position and a release position. When the controller 41 is located at the lock position, the controller 41 does not abut against the engagement plate 31. Thus, the lock mechanism or said engagement plate 31 is able to be switched between the first position and the second position without resistance. When the controller 41 is located at the release position, the controller 41 abuts against and presses on the engagement plate 31 with the distal end of the extend portion 412, so that the engagement plate 31 is pivoted toward the second position.

The restrain mechanism is used for abutting against the controller 41 when the shell inserts in the groove 23. By press of the restrain mechanism, motion of the controller 41 between the lock position and the release position is resisted. More specifically, please refer to FIG. 1, FIG. 4, and FIG. 5, the restrain mechanism includes a restrain member 51 which is disposed on the housing 2. The restrain member 51 extends and protrudes integrally from the outer housing 24 where adjacent to the groove 23. The restrain member 51 is located between the controller 41 and the groove 23. The restrain member 51 can be switched between an initial position and a restrain position. When the restrain member 51 is located at the initial position, the restrain member is partially received in the groove 23. Thus, the shell would press on the restrain member 51 and drives the restrain member 51 to the restrain position when the shell inserts into the groove 23. When the restrain member 51 is located at the restrain position, the restrain member 51 is located adjacent to or presses directly on the restrain portion 413 of the controller 41. Thus, the restrain member 51 abuts selectively against the controller 41, retraining motion of the controller 41 between the lock position and the release position. For restraining motion of the controller 41, the restrain member 51 may be arranged directly on or about the route of the controller 41. However, the restrain member 51 has its inherent elasticity. The location of the controller 41 can still be changed when user operates the activate portion harder. The restrain member 51 has elasticity and tendency to return to the initial position.

Figure 5:
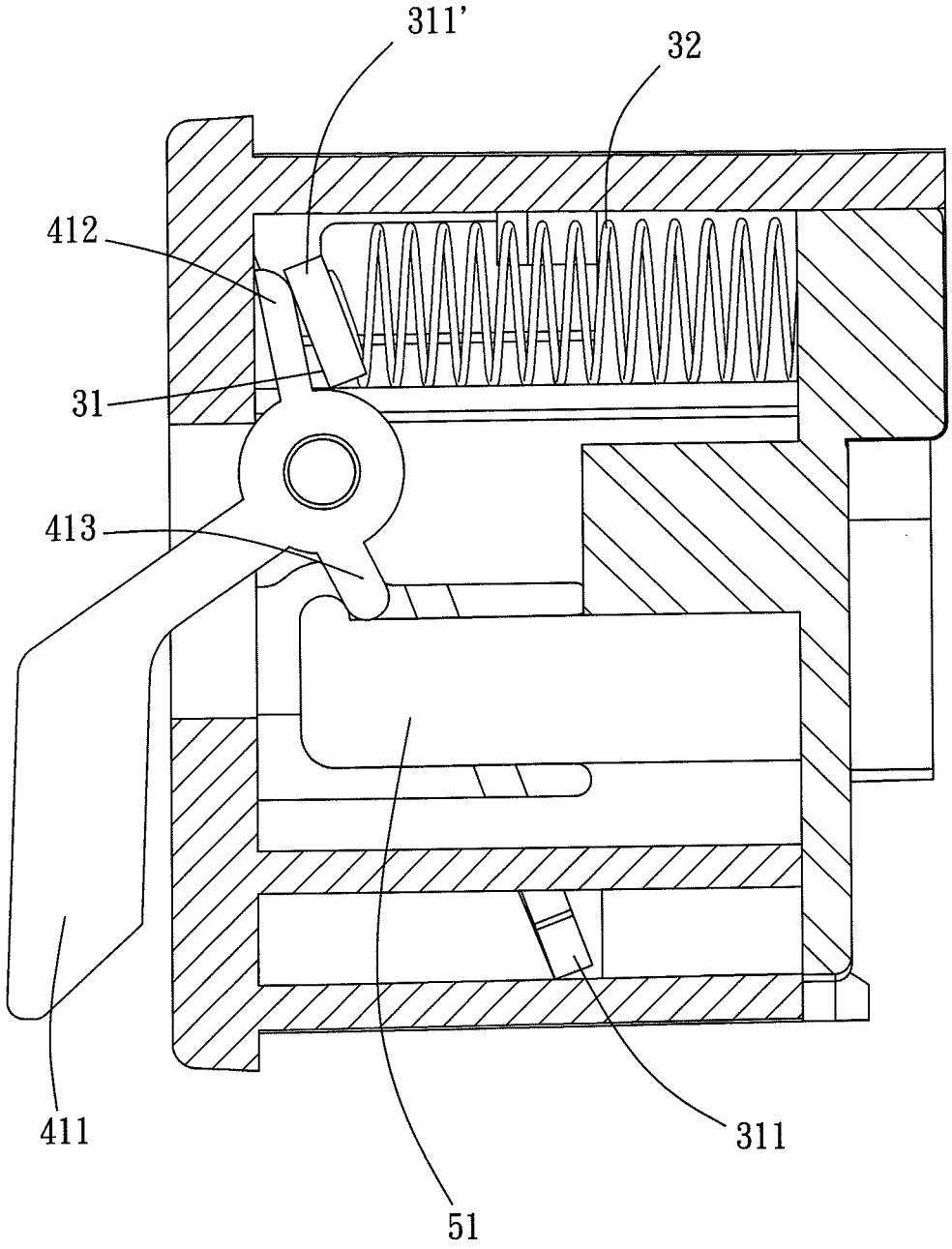
FIG. 5 is a profile showing a first embodiment of the present invention.
Figure 6:
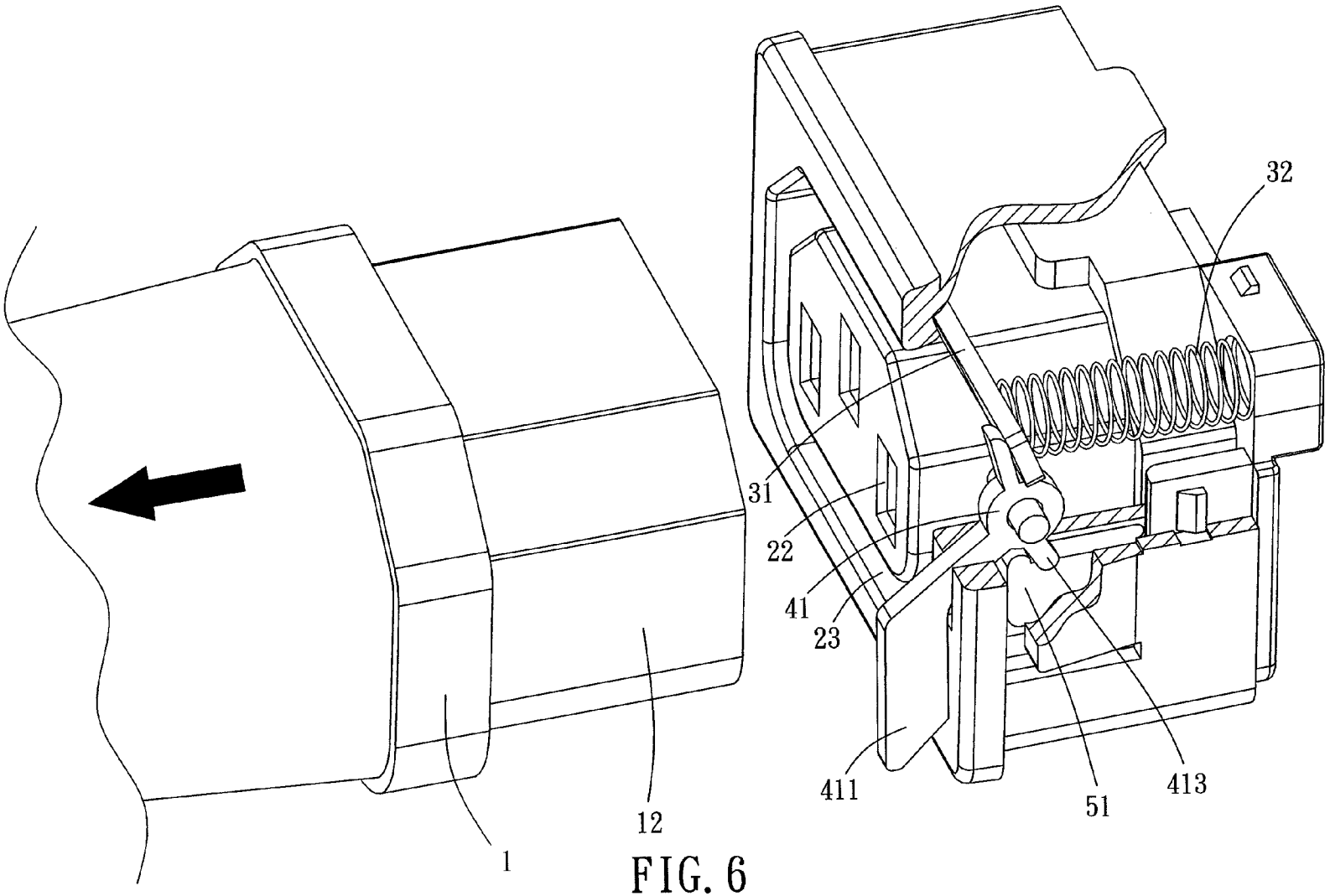
FIG. 6 is a schematic drawing showing detailed inner structure of a first embodiment of the present invention.

Please refer to FIG. 5 and FIG. 6 showing safety socket with no insertion of the plug. Accordingly, because of the appearance and the elasticity of the restrain member 51, the restrain member 51 is generally located at the initial position. The restrain member 51 is located apart from the restrain portion 413 of the controller 41. The engagement plate 31 pressed by the elastic member 32 is generally located at the first position. The engagement plate 31 presses on the extend portion 412 of the controller 41. The controller 41 is positioned at the lock position.

Figure 7:
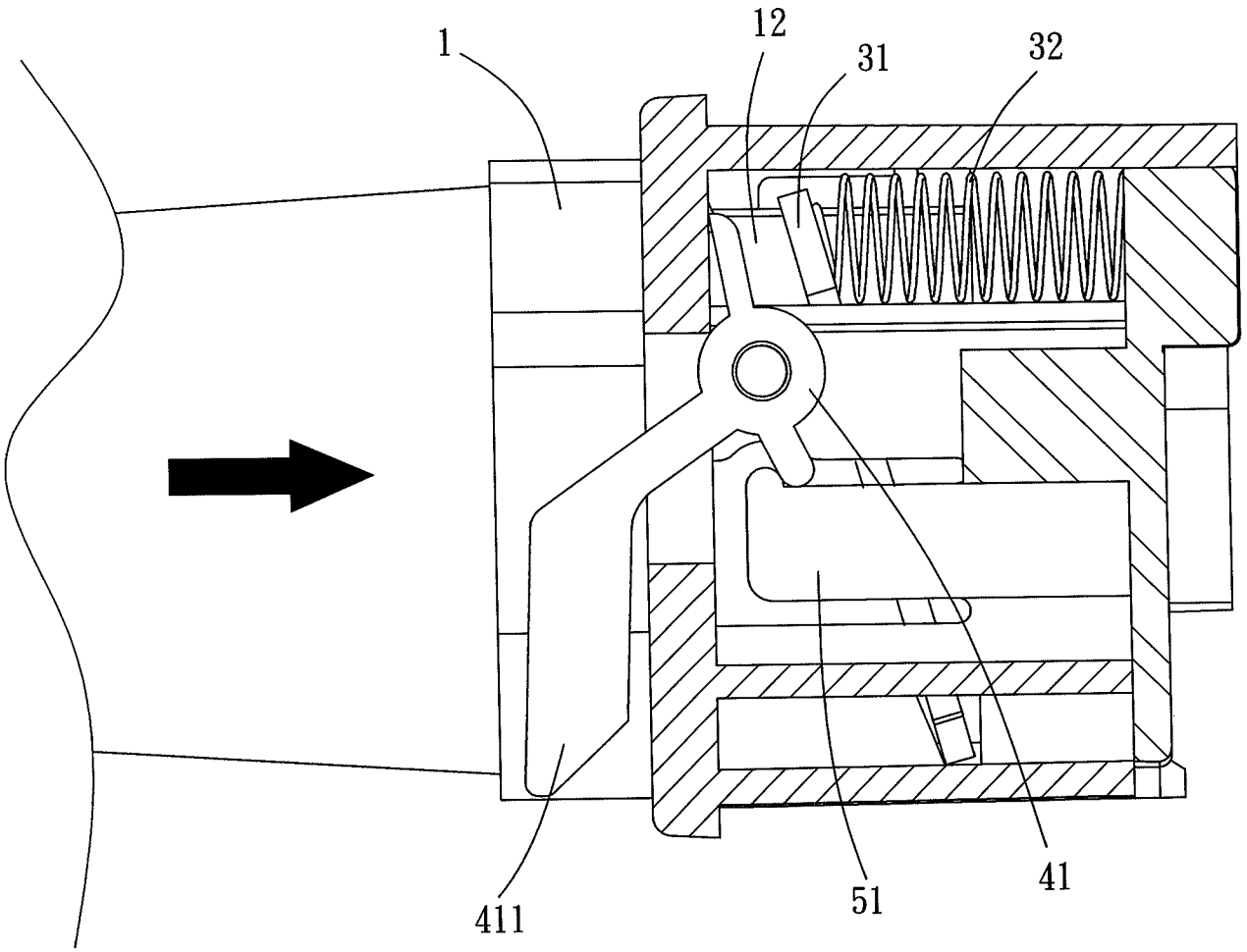
FIG. 7 and FIG. 8 are profiles showing operation conditions of a first embodiment of the present invention.

Please refer to FIG. 7. When the plug inserts in the socket holes, the shell 12 inserts in the groove accompanied with a slight movement of the engagement plate 31. However, the engagement plate 31 is still pressed by the elastic member 32, and is still tilted to clip and press on the shell 12. Therefore, insertion of the plug is allowed, but removal of the plug is resisted. In additionally, accompanied with the insertion, the shell 12 presses on the restrain member 51, driving the restrain member 51 to the restrain position. Thus, the controller 41 is unable to rotate randomly.

Figure 8:
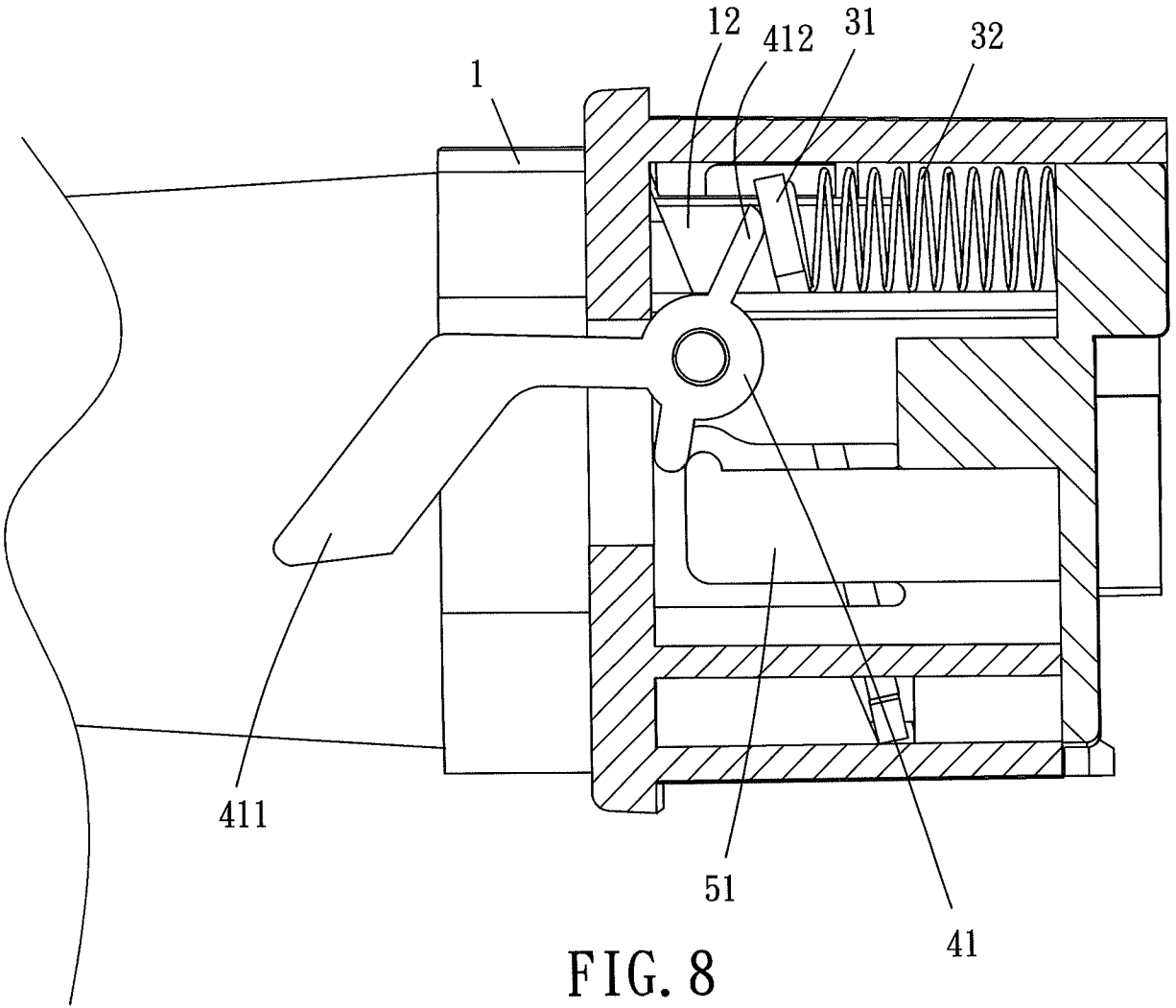

Please refer to FIG. 8. When user tries to remove the plug, user can operate and press the activate portion 411 harder, overcoming elasticity of the restrain member 51. Thus, the controller 41 is forced to rotate to the release position. Correspondingly, extend portion 412 presses and drives the engagement plate 31 toward the second position. The engagement plate 31 leaves and releases the shell 12. Thus, user can draw the plug 1 out of the safety socket without resistance caused by the lock mechanism. Because of the elastic forces provided by the elastic member 32 and the restrain member 51, the components of the safety socket are then returned to the positions as shown in FIG. 5 and FIG. 6 after withdrawal of the plug. The safety socket is then prepared for continuous operation.

Additionally, in some situation, user may abandon withdrawal of the plug after the controller 41 is rotated to the release position. In this case, user can rotate the activate portion and the controller 41 in an opposite direction. With manual operation, the controller 41 can be rotated to return to the lock position without withdrawal of the plug. The engagement plate 31 engages the shell 12, as shown in FIG. 7. The engagement plate 31 can be moved back to engage the shell 12 without removing the plug in advance.

According to the structure mentioned above, the safety socket includes the engagement plate which engages the shell of the plug for resisting removal of the plug. The engagement plate is then arranged within a periphery portion of the housing. The components of the safety socket are then arranged loose within easier spacing. Structure of the safety socket is simplified. Manufacturing and fabricating are facilitated, and durability and stability are improved.

Besides, refer to the operation condition mentioned above, the safety socket can be operated easily with single hand. Switching the controller and removing the plug can be achieved with single hand separately.

In addition, the controller can be switched for engaging and releasing the plug randomly without removing the plug in advance. Operation of the safety socket is simple and convenient.

Figure 9:
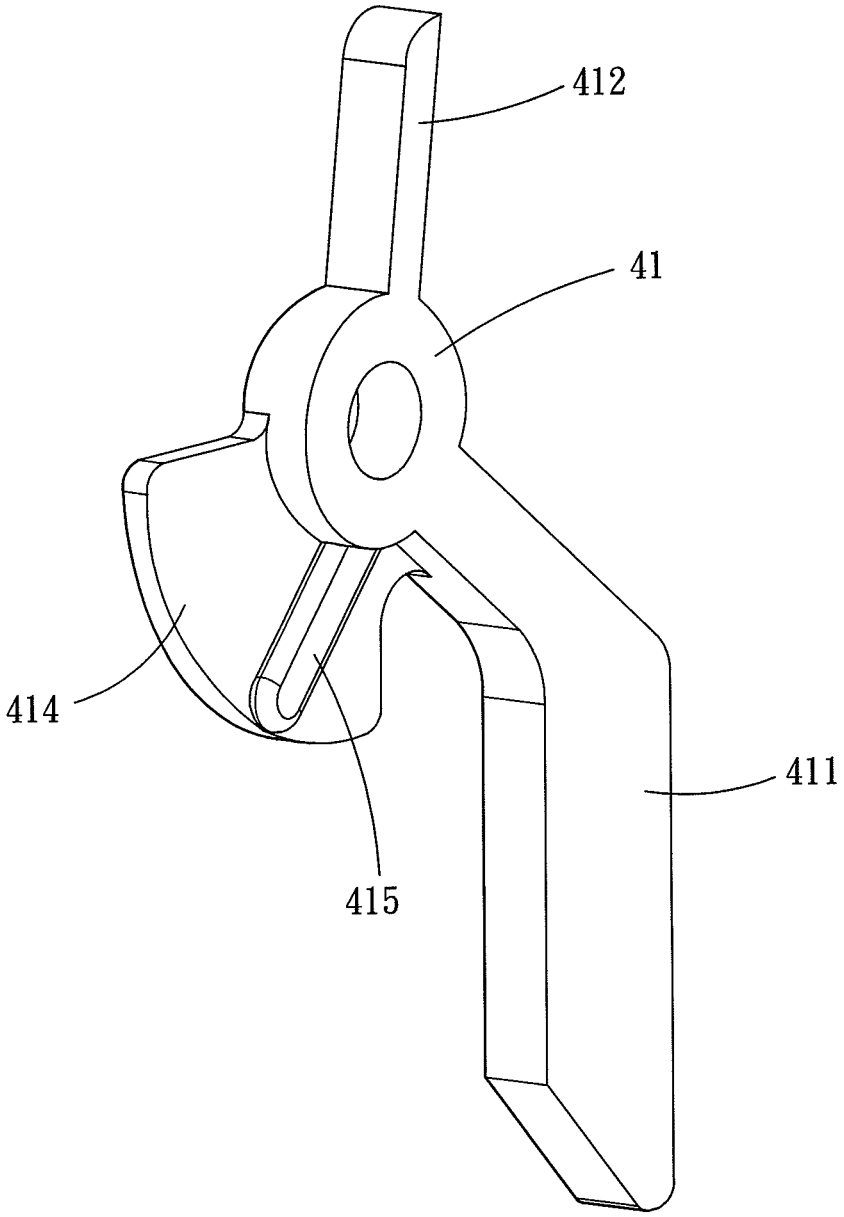
FIG. 9 is a stereogram showing a controller of a second embodiment of the present invention.
Figure 10:
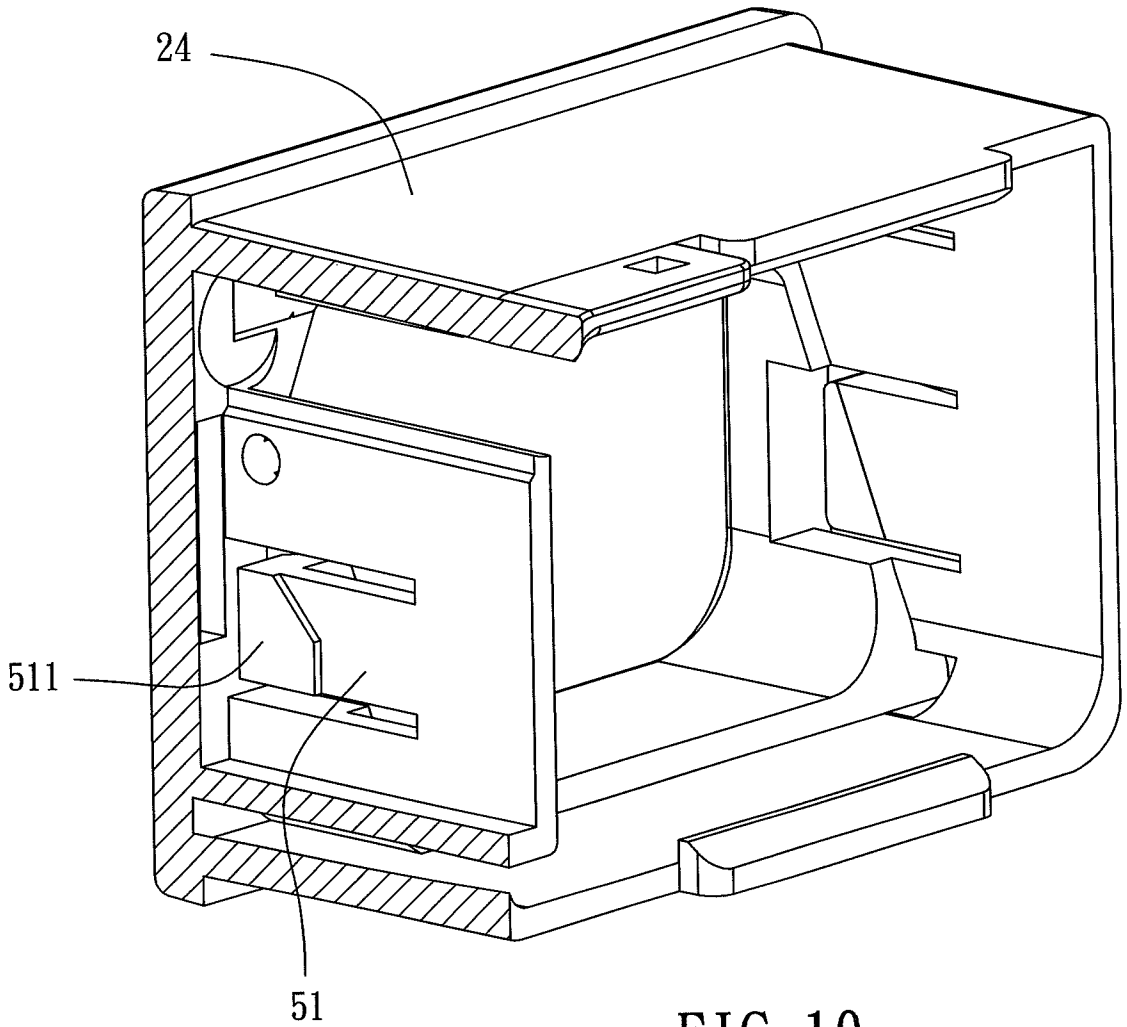
FIG. 10 is a stereogram showing an outer housing of a second embodiment of the present invention.
Figure 11:
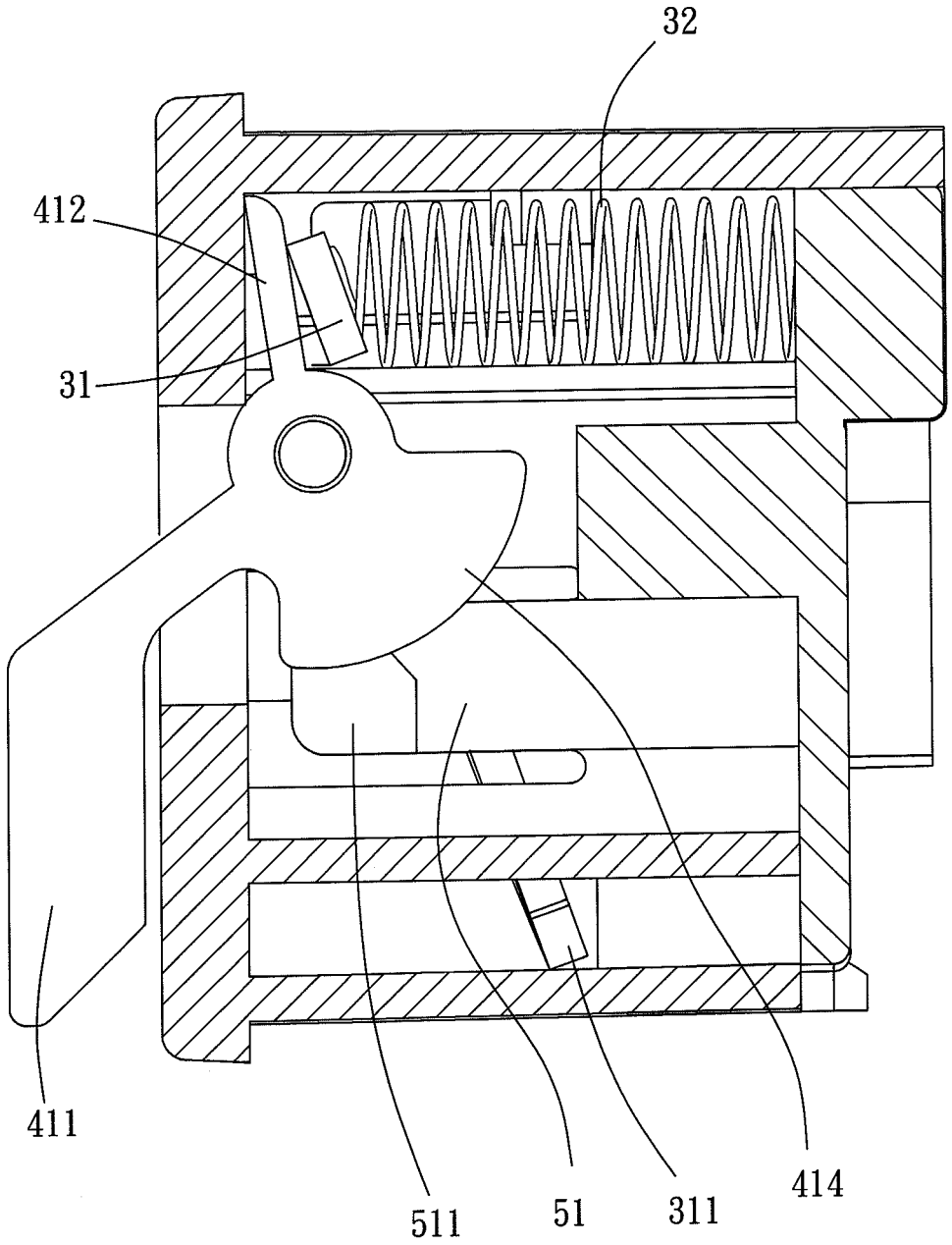
FIG. 11 is a profile showing a second embodiment of the present invention.
Figure 12:
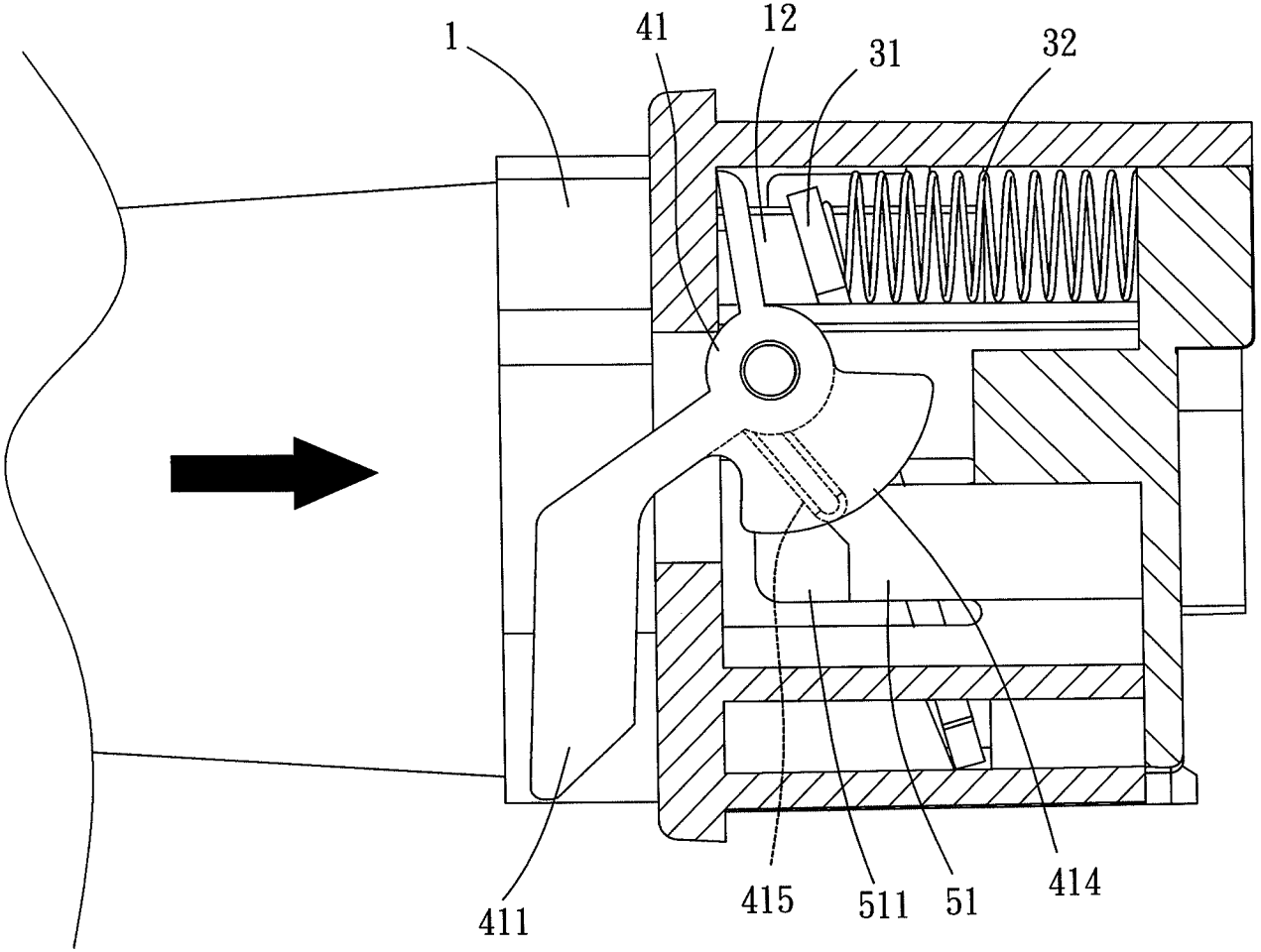
FIG. 12 and FIG. 13 are profiles showing operation conditions of a second embodiment of the present invention.
Figure 13:
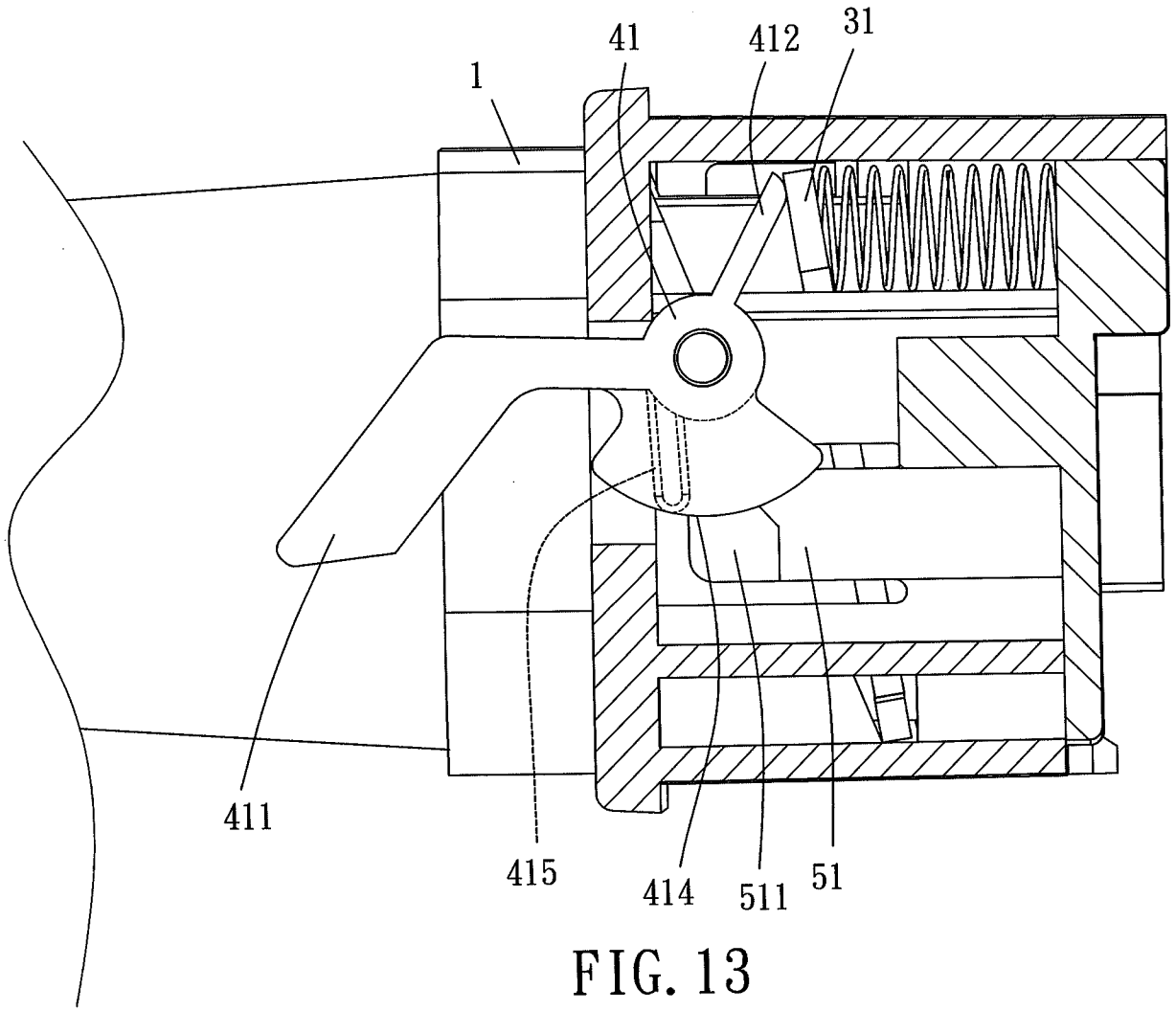

Please refer to FIG. 9 to FIG. 11. In a second embodiment of the present invention, the structure of the safety socket is roughly the same as the structure described above. Comparatively, the controller is provided with a restrain portion 414 which has an appearance different from an extension pole. The restrain portion 414 is formed as a sector as shown in FIG. 9. In addition, the restrain portion 414 is formed with a protruding rib 415. The rib 415 is located at where the restrain portion 414 closes to the restrain member 51. In other words, the rib 415 is located at a side of the restrain portion 414 approaching to the restrain member 51. A protruding direction defined by the rib 415 is parallel to the shaft, as shown in FIG. 10. Correspondingly, the restrain member 51 is formed with a protrusion 511 at a side of the restrain member 51 approaching to the restrain portion 414. Please refer to FIG. 11 to FIG. 13. The restrain portion 414 abuts against the protrusion 511 of the restrain member 51 with the rib 415. Motion of the controller 41 is then resisted by the restrain member 51. However, as shown in FIG. 12 and FIG. 13, with a suitable force of manual operation, user can still switch the controller 41 or the activate portion 411 back and forth. Thus, operation condition and effects as described in the first embodiment are also achieved in the second embodiment.

To conclude, the safety socket as described above has a simplified structure. Manufacturing and fabricating are facilitated, and durability and stability are improved. Also, operation of the safety socket is simple and convenient.

What is claimed is:

1. A safety socket, comprising:

a housing, having a front surface, the front surface being formed with a group of socket holes which comprises at least two insertion holes and a groove, the groove enclosing said two insertion holes, the group of socket holes being adapted for a corresponding plug to insert therein, the plug having at least two conductive pins each of which is able to insert in one of the insertion holes and a shell which is able to insert in the groove;

a lock mechanism, disposed in the housing, the lock mechanism being located adjacent to the groove, the lock mechanism being able to be switched between a first position and a second position, the shell being able to insert into and escape from the groove when the lock mechanism is located at the second position, the lock mechanism intervening in the groove when the lock mechanism is switched toward the first position so that removal of the shell which is inserted in the groove is prohibited;

a switch mechanism, disposed on the housing, the switch mechanism being adapted for manual operation to switch the lock mechanism;

wherein the shell forms an internal space and encompasses the at least two conductive pins located within the internal space;

wherein the housing has an outer surrounded wall and a central post formed with the at least two insertion holes, and the groove is formed as a surrounded slot which surrounds the central post and locates between the central post and the outer surrounded wall;

wherein the lock mechanism includes at least one engagement portion projecting between the central post and the outer surrounded wall, and when the lock mechanism is located at the first position, the at least one engagement portion is frictionally positionally enaged circumferential surface of the shell which is located between the central post and the outer surrounded wall and traverse to the front surface.

2. The safety socket of claim 1, wherein the switch mechanism is adapted for manual operation to switch the lock mechanism to the second position.

3. The safety socket of claim 2, wherein the switch mechanism comprises a controller, the controller is able to be switched between a lock position and a release position, the lock mechanism is able to be switched between the first position and the second position when the controller is located at the lock position, the controller pushes the lock mechanism toward the second position when the controller is located at the release position, so that the shell is able to insert into and escape from the groove without resistance.

4. The safety socket of claim 3, wherein the safety socket further comprises a restrain mechanism which is utilized for abutting against the controller when the shell inserts in the groove, so that motion of the controller between the lock position and the release position is resisted.

5. The safety socket of claim 4, wherein the restrain mechanism comprises a restrain member which is disposed on the housing, the restrain member is located adjacent to the groove, the restrain member is able to be switched between an initial position and a restrain position, the restrain member is partially received in the groove when the restrain member is located at the initial position, the shell presses on the restrain member and drives the restrain member to the restrain position when the shell inserts into the groove, the restrain member abuts selectively against the controller, retraining motion of the controller between the lock position and the release position, the restrain member has a tendency to return to the initial position.

6. The safety socket of claim 5, wherein the controller is able to rotate about a shaft between the lock position and the release position, the controller has an activate portion, an extend portion, and a restrain portion each of which stretches away from the shaft, the activate portion is adapted for manual operation for driving the controller to rotate, a distal end of the extend portion abuts against the lock mechanism, the restrain portion selectively abuts against the restrain member.

7. The safety socket of claim 6, wherein the shaft is parallel to the front surface.

8. The safety socket of claim 6, wherein the restrain portion is formed as a pole, the restrain portion abuts against the restrain member from a distal end thereof.

9. The safety socket of claim 6, wherein the restrain portion is formed with a protruding rib, the rib is located at where the restrain portion closes to the restrain member, a protruding direction defined by the rib is parallel to the shaft, the restrain portion abuts against the restrain member from the rib.

10. The safety socket of claim 1, wherein the lock mechanism comprises an engagement plate, the engagement plate is able to rotate about an axis which is parallel to the front surface, the engagement plate is disposed adjacent to the groove.

* * * * *